US012018687B2

(12) United States Patent
Kelsch et al.

(10) Patent No.: US 12,018,687 B2
(45) Date of Patent: Jun. 25, 2024

(54) ROTOR UNIT AND ECCENTRIC SCREW PUMP

(71) Applicant: VISCOTEC PUMPEN-U. DOSIERTECHNIK GMBH, Töging a. Inn (DE)

(72) Inventors: Horst Kelsch, Töging (DE); Jürgen Auer, Niederbergkirchen (DE)

(73) Assignee: VISCOTEC PUMPEN-U. DOSIERTECHNIK GMBH, Töging a. Inn (DE)

( * ) Notice: Subject to any disclaimer, the term of this patent is extended or adjusted under 35 U.S.C. 154(b) by 0 days.

(21) Appl. No.: 18/039,932

(22) PCT Filed: Nov. 10, 2021

(86) PCT No.: PCT/EP2021/081274

§ 371 (c)(1),
(2) Date: Jun. 1, 2023

(87) PCT Pub. No.: WO2022/117300

PCT Pub. Date: Jun. 9, 2022

(65) Prior Publication Data

US 2023/0417241 A1 Dec. 28, 2023

(30) Foreign Application Priority Data

Dec. 4, 2020 (EP) ..... 20211922

(51) Int. Cl.

| | |
|---|---|
| ***F01C 1/107*** | (2006.01) |
| ***F04C 2/107*** | (2006.01) |
| ***F04C 15/00*** | (2006.01) |

(52) U.S. Cl.
CPC ..... *F04C 2/107* (2013.01); *F04C 2/1071* (2013.01); *F04C 15/0003* (2013.01); *F04C 15/0065* (2013.01); *F04C 2240/601* (2013.01)

(58) Field of Classification Search
CPC .... F04C 2/107; F04C 2/1071; F04C 15/0003; F04C 15/0038; F04C 15/003;
(Continued)

(56) References Cited

U.S. PATENT DOCUMENTS

| | | | |
|---|---|---|---|
| 2,545,604 | A | 3/1951 | Byram |
| 2,545,626 | A | 3/1951 | Moineau |

(Continued)

FOREIGN PATENT DOCUMENTS

| | | | |
|---|---|---|---|
| DE | 20 2007 018 923 | U1 | 11/2009 |
| EP | 2 416 014 | A1 | 2/2012 |
| JP | S55 1422 | A | 1/1980 |

OTHER PUBLICATIONS

JP2010001876A—Suhara et al.—Unaxial Eccentric Screw Pump—Jan. 7, 2010—the English Machine Translation copy. (Year: 2010).*

(Continued)

*Primary Examiner* — Theresa Trieu
(74) *Attorney, Agent, or Firm* — Alleman Hall & Tuttle LLP

(57) ABSTRACT

A rotor unit for an eccentric screw pump, comprising a drive shaft which is drivable by means of a drive element of the eccentric screw pump, a helical rotor, and a flex shaft connecting the drive shaft to the rotor, wherein the flex shaft is at least in part accommodated within in the drive shaft, and wherein between the flex shaft and the drive shaft a gap extending around the flex shaft is provided, which allows for a radial movement of the flex shaft within the drive shaft.

16 Claims, 12 Drawing Sheets

(58) Field of Classification Search
CPC ..... F04C 15/0065; F04C 15/0076; F04C 2240/60; F04C 2240/601
See application file for complete search history.

(56) References Cited

U.S. PATENT DOCUMENTS

| | | | | |
|---|---|---|---|---|
| 5,769,618 | A * | 6/1998 | Ono | F04C 2/1071 418/48 |
| 2010/0040498 | A1* | 2/2010 | Akamatsu | F04C 2/1071 418/48 |
| 2012/0039734 | A1* | 2/2012 | Sakakihara | F04C 2/1071 418/48 |

OTHER PUBLICATIONS

JP60142078A—Ono et al.—Rotor Supporting Device for Single-Shaft Eccentric Screw Pump—Jul. 27, 1985—the English Machine Translation copy. (Year: 1985).*

ISA European Patent Office, International Search Report Issued in Application No. PCT/EP2021/081274, Dec. 10, 2021, WIPO, 4 pages.

* cited by examiner

ROTOR UNIT AND ECCENTRIC SCREW PUMP

FIELD

The present invention relates to a rotor unit for an eccentric screw pump and an eccentric screw pump, in particular a 3D printing head comprising such a rotor unit.

BACKGROUND

Eccentric screw pumps comprise a stator as well as a rotor rotatably accommodated in the stator. When the rotor is rotated, a medium to be dispensed is conveyed, according to the endless piston principle, in a longitudinal direction of the eccentric screw pump away from a drive element of the eccentric screw pump by the interaction of the rotor with the stator. The feed volume per time unit depends on the speed, size, pitch and geometry of the rotor. With such eccentric screw pumps, high-precision dispensing processes with a high repeatability are possible.

SUMMARY

During operation of such an eccentric screw pump, the rotor performs an eccentric movement in the stator. To accomplish this eccentric movement, the rotor is connected to a drive shaft via a flexibly deformable shaft or a joint. Viewed in the longitudinal direction of the eccentric screw pump, this results in a relatively large overall size. This overall size results in a large dead space in a pump housing of the eccentric screw pump. Particularly in the case of expensive media, it is desirable for this dead space volume to be as small as possible.

DE 20 2007 018 923 U1 describes an eccentric screw pump as mentioned above having a rotor unit comprising a drive shaft, a rotor and a flexible shaft disposed between the drive shaft and the rotor.

Against this background, it is an object of the present invention to provide an improved rotor unit for an eccentric screw pump.

Therefore, a rotor unit for an eccentric screw pump is proposed. The rotor unit comprises a drive shaft, which is drivable by means of a drive element, a helical rotor, and a flex shaft connecting the drive shaft to the rotor, wherein the flex shaft is at least in part accommodated within in the drive shaft, and wherein between the flex shaft and the drive shaft a circumferential gap is provided, which allows for a radial movement of the flex shaft within the drive shaft.

By accommodating the flex shaft at least in part within the drive shaft, a shortened overall size in a longitudinal direction of the rotor unit, which is oriented from the drive shaft toward the rotor, can be achieved. This makes it possible to design the eccentric screw pump in such a way that it has a lowest possible dead volume. This is particularly advantageous when dispensing expensive media.

The rotor unit can also be referred to as a rotor train, in particular, a compact rotor train. The terms "rotor unit", "rotor train" and "compact rotor train" can be used interchangeably as desired. The rotor unit is preferably part of the eccentric screw pump. The rotor unit is exchangeable. The drive shaft is, in particular, rotatably mounted about an axis of symmetry in a bearing housing portion of the eccentric screw pump. To this end, bearing elements in the form of roller bearings or plain bearings may be provided. The drive element may be an electric motor. The drive element may comprise a gear mechanism, for example, a planetary gear.

The drive element is, in particular, operable to apply a torque to the rotor unit. The drive shaft transfers the torque to the flex shaft which in turn transfers the torque to the rotor.

The rotor is fixedly connected to the drive shaft via the flex shaft. At the front end of the flex shaft, the rotor is provided, which interacts with a stator of the eccentric screw pump. In the present context, the rotor being "helical" means, in particular, that the rotor has a screw-like or helical outer contour. The terms "screw-like" and "helical" can be arbitrarily exchanged. When the eccentric screw pump is in operation, the rotor interacts with the stator, which has an aperture in which the rotor is disposed. The aperture of the stator has a screw-like or helical inner contour corresponding to the rotor. The stator is also part of the eccentric screw pump. The stator is exchangeable.

In the present context, a "flex shaft means a shaft, in particular more generally a component, which permits an eccentric movement of the rotor relative to the drive shaft. To this end, the flex shaft may have, for example, a joint, in particular a universal or cardan joint, or several joints. The flex shaft may also be referred to as flexible shaft or articulated shaft. However, particularly preferably the flex shaft is elastically deformable. It is, however, not mandatory that the flex shaft itself is flexibly deformable. The flex shaft may also be a flexible rod, in particular, a plastic flexible rod, or may be referred to as such. In this case, the flex shaft may be made, for example, from a Polyetheretherketone (PEEK), Polyethylene (PE) or the like. Alternatively, the flex shaft may be made of a, in particular plastic-coated, steel cable.

The rotor is connected to the drive shaft via the flex shaft, which drive shaft is driven by means of the drive element when the eccentric screw pump is in operation. When the rotor rotates in the stator, a medium to be dispensed or conveyed is conveyed, according to the endless piston principle, by the interaction with the stator, in particular the aperture of the stator, in the longitudinal direction of the eccentric screw pump away from the drive shaft. The feed volume per time unit depends on the speed, size, pitch and geometry of the rotor.

In the present context, the flex shaft being accommodated "within" the drive shaft means that the flex shaft at least in part passes through the drive shaft. The gap, which preferably extents fully around the flex shaft, is provided between the flex shaft and the drive shaft. As mentioned above, the rotor performs an eccentric movement which causes the flex shaft disposed within the drive shaft to deflect in a radial direction oriented perpendicular to the axis of symmetry of the rotor unit. The radial movement may also be an eccentric movement. However, this is not mandatory.

The medium to be dispensed may be, for example, an adhesive and/or a sealant, water, an aqueous solution, a paint, a suspension, a viscous raw material, an emulsion or a grease. The medium may also be a gel or alginate. The medium may comprise, in particular, human, animal or plant cells. The medium may be liquid or paste-like. "Paste" or "paste-like" medium means a solid-liquid mixture, in particular a suspension, comprising a high content of solids. For example, the medium may have a filler content, for example so-called microballoons, fibrous, in particular short-fibered, content, or the like. The medium may be an alginate, a bone wax, or any other biological or medical material, for example. The medium may further also comprise bacteria or viruses. A suitable medium can be selected, based on the use of the eccentric screw pump in bio medicine, pharma technology or industry. The medium may also be a cyanoacrylate, for example. The medium may also be an anaerobic adhesive.

According to an embodiment, the drive shaft comprises a cylindrical bearing face on its outside, wherein the flex shaft extents at least in part within the bearing face.

The bearing face is preferably constructed rotationally symmetric to the axis of symmetry of the rotor unit. Bearing elements, in particular roller bearings or plain bearings, may be attached on the bearing face. In the present context, the flex shaft extending "within" the bearing face means that the flex shaft, viewed in the radial direction, is surrounded by the bearing face. This does not preclude, however, that the flex shaft, viewed in the longitudinal direction, extends at least in part beyond the bearing face. The flex shaft may also at least in part extent within a sealing face of the drive shaft. The sealing face is also preferably cylindrical. The sealing face is also provided on the outside of the drive shaft.

According to another embodiment, the drive shaft comprises a recess, in which the flex shaft is received, wherein the recess widens from a first end of the recess facing away from the rotor to a second end of the recess facing the rotor.

The recess is, in particular, a bore provided in the drive shaft. The recess extends in the longitudinal direction and is preferably rotationally symmetric to the axis of symmetry. The flex shaft is accommodated in the recess. This does not preclude, however, that the flex shaft extends beyond the drive shaft. The flex shaft may also be reset in relation to the drive shaft. In the present context, the recess "widens" means, in particular, that a diameter of the recess is greater on the second end than on the first end. This enables a radial movement of the flex shaft, wherein the radial movement on the first end has a smaller amplitude than on the second end.

According to another embodiment, the recess is stepped or conical.

In the present context, "stepped" means that the recess is a stepped bore, which is made up of several bore sections with different diameters. In the present context, "conical" or "frustoconical" means that a diameter of the recess continuously increases from the first end to the second end without steps.

According to another embodiment, the flex shaft is at its first end fixedly connected to the drive shaft.

The flex shaft may be positively connected to the drive shaft. To this end, the drive shaft may have an interface. A positive connection is created by interlocking or engaging behind of two connecting partners, in this case the flex shaft and the drive shaft. For example, the flex shaft may be bolted to the drive shaft. However, the flex shaft may also be connected to the drive shaft by a material bond. In material bond connections, the connecting partners are held together by atomic or molecular forces. Material bond connections are non-releasable connections which can only be separated by destroying the connecting means and/or the connecting partners. The flex shaft is, for example, glues into the drive shaft or welded, in particular, laser welded, or soldered to it.

According to another embodiment, the gap is at least in part filled with an elastically deformable sealing compound.

The sealing compound is optional. The sealing compound prevents the medium to be dispensed from entering the gap. The sealing compound is preferably a material with a low Shore hardness. The sealing compound is preferably elastically deformable such that it does not or at least only marginally hinders the radial movement of the flex shaft in the drive shaft. For example, the sealing compound may be or comprise a silicone, in particular a two-component silicone, a silicone that cures at room temperature or RTV silicone (Room Temperature Vulcanizing silicone), a silicone that cures at high temperatures, Thermoplastic Elastomer (TPE), in particular a Thermoplastic Polyurethane (TPU), a thermoplastic Vulcanizate (TPV), a Fluoro Vinyl Methyl Silicone Rubber (FVMQ) or the like.

According to another embodiment, the sealing compound is foamed.

This additionally increased the deformability of the sealing compound. The sealing compound may have an open-cell or a closed-cell structure, for example. The sealing compound may be sponge-rubber-like.

According to another embodiment, the rotor unit further comprises a sealing element disposed on the end face between the drive shaft and the rotor.

In the present context, "at the end face" means between an end face of the drive shaft and the rotor, in particular a shoulder of the rotor. The sealing element may be an O-ring. The sealing element may also be disk-shaped or frustoconical. The sealing element may be made of a thermoplastic elastomer (TPE), in particular from a thermoplastic polyurethane (TPU). The sealing element may also be made of rubber.

According to another embodiment, the rotor comprises a circumferential shoulder, wherein the sealing element is disposed between the shoulder and an end face of the drive shaft.

In particular, the sealing element between the shoulder and the end face are pressed in. The sealing element prevents the medium to be dispensed from entering the gap provided between the flex shaft and the drive shaft. This means that the sealing compound is not necessary when the sealing element is provided. This does not preclude, however, that both the sealing compound and the sealing element are provided.

According to another embodiment, the sealing element is bellows-like.

This makes the sealing element particularly easily deformable, whereby the radial movement of the flex shaft in the drive shaft is not hindered. In the present context, "bellows-like" means, in particular, that the sealing element is pleated or has at least one pleat.

According to another embodiment, the flex shaft is, viewed in a longitudinal direction of the rotor unit, fully accommodated with in the drive shaft.

This means that the flex shaft, viewed in the longitudinal direction, does not extend beyond the drive shaft. Alternatively, viewed in the longitudinal direction, the flex shaft may also extend beyond the drive shaft. The flex shaft may also be reset into the drive shaft.

According to another embodiment, the drive shaft comprises at least one sealing lip, which is, in particular, made in one piece with the drive shaft, for sealing the drive shaft against a housing of the eccentric screw pump.

The number of sealing lips is arbitrary. For example, two or three sealing lips are provided. It is also possible that exactly one sealing lip is provided. If multiple sealing lips are provided, then the sealing lips are arranged spaced apart in the longitudinal direction. The sealing lips preferably abut a cylindrical sealing face of a pump housing portion of the eccentric screw pump. The sealing lip is, for example, directly injection-molded onto the drive shaft using a plastic injection molding process. The sealing lip may be made of the same material as the drive shaft. Alternatively, the sealing lip may be made of a different material than the drive shaft. For example, the sealing lip may be made of a softer material then the drive shaft. In this case, a multi-component injection process may be used for manufacturing the rotor unit.

According to another embodiment, the drive shaft and the rotor and/or the flex shaft form an integral component, in particular, a component made of one material.

In the present context, "integral" means that the drive shaft, the rotor and/or the flex shaft form a common component and are not assembled from different components. In the present context, "made of one material" means, in particular, that the drive shaft, the rotor and/or the flex shaft are made of the same material throughout. For example, the rotor unit may be an injection-molded plastic component. A multi-component plastic injection molding process may also be used. In this case, while the drive shaft, the rotor and/or the flex shaft may form a one-piece component, they may be made of different plastic materials.

According to another embodiment, the rotor unit is a disposable article.

Alternatively, the rotor unit can be used multiple times. If the rotor unit is a disposable article, then it is made of a plastic material. Preferably, the rotor unit can be sterilized. This way the rotor unit can be used in bio technology.

Further, an eccentric screw pump, in particular a 3D print head comprising such a rotor unit is proposed.

The eccentric screw pump may thus be used in additive or generative manufacturing. The eccentric screw pump may be mains operated. However, the eccentric screw pump may also be battery operated. This way the eccentric screw pump is independent from a power grid. Thus the eccentric screw pump can function as a hand-held device. The eccentric screw pump can thus be used for dispensing solder paste at a manual work station, for example. The eccentric screw pump can thus be used in the manner of a pipetting device or pipetting aid, with the difference that by using the eccentric screw pump, preferably even highly viscous media can be dispensed. Furthermore, an eccentric screw pump functioning in such a self-contained manner can also be used for rapid wound care, for example, for field care of military personnel, or in the operating room. In this case, for example, waxes, in particular bone waxes, adhesives, dental prostheses materials, artificial skin or the like can be dispensed.

In the present context, "one" is not necessarily to be understood as limiting to exactly one element. Rather, multiple elements, such as two, three, or more, may also be provided. Also, any other counting word used herein is not to be understood to imply a limitation to exactly the number of elements stated. Rather, numerical variations upward and downward are possible unless otherwise indicated.

Other possible implementations of the rotor unit and/or the eccentric screw pump also comprise combinations of features or embodiments that are not explicitly mentioned above or described below in the context of the exemplary embodiments. The person skilled in the art will also add individual aspects as improvements or additions to the respective basic form of the rotor unit and/or the eccentric screw pump.

Further advantageous embodiments and aspects of the rotor unit and/or eccentric screw pump are subject of the dependent claims as well as the exemplary embodiments of the rotor unit and/or eccentric screw pump described below. In the following, the rotor unit and/or the eccentric screw pump are explained in more detail on the basis of preferred embodiments with reference to the enclosed figures.

BRIEF DESCRIPTION OF THE DRAWINGS

In the figures, identical or functionally identical elements have been provided with the same reference numbers, unless otherwise indicated.

DETAILED DESCRIPTION

Figure 1:
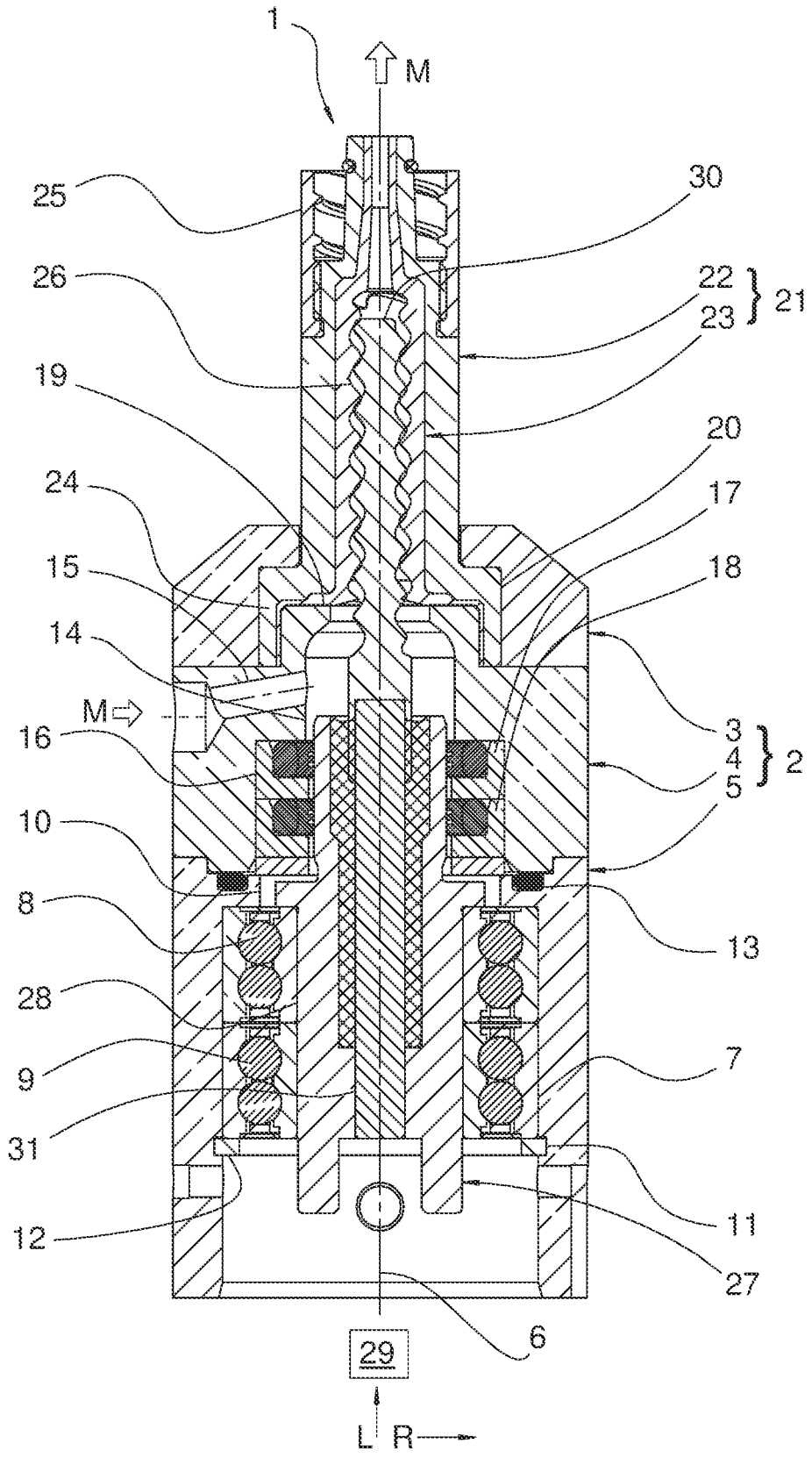
FIG. 1 shows a schematic partial sectional view of an embodiment of an eccentric screw pump.

FIG. 1 shows a schematic partial sectional view of an embodiment of an eccentric screw pump 1 for dispensing a liquid or paste-like medium M. The medium M may be an alginate, a bone wax or any other biological or medical material, for example. The medium M may contain human, animal or plant cells. The medium may further also comprise bacteria or viruses. A suitable medium can be M selected, depending on the use of the eccentric screw pump 1 in bio medicine, pharma technology or industry. The medium M may also be a cyanoacrylate, for example. The medium M may also be an anaerobic adhesive.

The eccentric screw pump 1 comprises a housing 2 comprising a front housing portion 3, a pump housing portion 4, and a bearing housing portion 5. The pump housing portion 4 is disposed between the front housing portion 3 and the bearing housing portion 5. The housing 2 further comprises a rear housing portion (not shown). The front housing portion 3, the pump housing portion 4 and/or the bearing housing portion 5 may be fixedly connected to one another, for example, screwed together. The front housing portion 3, the pump housing portion 4 and the bearing housing portion 5 can preferably be detached from one another, for example, for cleaning purposes. The housing 2 is designed substantially rotationally symmetrical to a central axis or axis of symmetry 6.

The bearing housing portion 5 comprises a centrally disposed bore 7, which accommodates a first bearing element 8 and a second bearing element 9. The bearing elements 8, 9 may be plain bearings, for example. Alternatively, the bearing elements 8, 9 may be roller bearings, as shown in FIG. 1. Facing the pump housing portion 4, the first bearing element 8 abuts a shoulder 10 of the bearing housing portion 5, which shoulder protrudes into the bore 7. Facing away from the pump housing portion 4, a groove 11 extending around the axis of symmetry 6 is provided in the bearing housing portion 5. The groove 11 accommodates a locking ring 12 which fixes the bearing elements 8, 9 to the bearing housing portion 5.

Between the bearing housing portion 5 and the pump housing portion 4, a sealing element 13 is accommodated which is pressed-in between the pump housing portion 4 and the bearing housing portion 5. A groove extending annularly around the axis of symmetry 6 is provided in the shoulder 10 for accommodating the sealing element 13. The bearing housing portion 5 may be made of a metallic material such as steel or aluminum. Alternatively, the bearing housing portion 5 may also be made of a plastic material.

The pump housing portion 4 comprises a receiving chamber 14, which is centrally provided in the pump housing portion 4, for receiving the medium M. The receiving chamber 14 is constructed rotationally symmetrical to the axis of symmetry 6. The medium M may be supplied to the receiving chamber 14 via a supply port 15 provided in the pump housing portion 4 as a bore. The supply port 15 may be oriented obliquely or perpendicular to the axis of symmetry 6. For supplying the medium M, a replaceable cartridge accommodating the medium M can be connected to the supply port 15, for example.

In the direction of the bearing housing portion 5, a sealing face 16, which cylindrically extends around the axis of symmetry 6, abuts the receiving chamber 14. Two sealing elements 17, 18 are mounted on the sealing face 16. The sealing elements 17, 18 may be radial shaft seals, for example. However, the sealing elements 17, 18 may also be O-rings. The pump housing portion 4 extents into the front housing portion 3 with a cylindrically formed projection 19. The receiving chamber 14 extends through the projection 19. The front housing portion 3 comprises a center bore 20 in which the projection 19 of the pump housing portion 4 is accommodated. The bearing housing portion 4 is preferably be made of a metallic material such as steel or aluminum. Alternatively, the pump housing portion 4 may also be made of a plastic material.

The eccentric screw pump 1 further comprises an at least partially deformable stator 21. The stator 21 has an outer portion 22 and an inner portion 23 which is accommodated in the outer portion 22. The outer portion 22 comprises a base section 24 disposed between the bearing housing portion 4 and the front housing portion 3, in particular, between the projection 19 and the bore 20. This way, the stator 21 can be releasably connected to the housing 2 via the front housing portion 3.

On the front, meaning facing away from the front housing portion 3, the outer portion 22 comprises a Luer-lock connector 25. Via the Luer-lock connector 25, a syringe, for example, can be connected to the eccentric screw pump 1. The inner portion 23 is preferably an elastically deformable elastomeric element comprising a center aperture 26. The aperture 26 preferably comprises a screw-shaped or helical internal contour. The inner portion 23 is made of an elastomer such as rubber or a thermoplastic elastomer (TPE). The outer portion 22 is preferably made of a harder plastic material than the inner portion 23. The outer portion 22 may also be made of a metallic material such as stainless steel or aluminum.

The eccentric screw pump 1 further has a rotor unit 27. The rotor unit 27 may also be referred to as a rotor train or compact rotor train. The rotor unit 27 comprises a drive shaft 28 which is rotatably mounted in the bearing housing portion 5 by means of the bearing elements 8, 9. The drive shaft 28 can be caused to rotate about the axis of symmetry 6 by means of a drive element 29. The drive element 29 may be an electric motor. The drive element 29 may comprise a gear mechanism, for example, a planetary gear. The drive element 29 is coupled to the drive shaft 28 in any manner such that the drive element 29 can apply torque to the drive shaft 28. The drive element 29 is accommodated in the housing 2, in particular in the rear housing portion (not shown).

In addition to the drive shaft 28, the rotor unit 27 comprises a rotor 30 which is helical and thus comprises a screw-like or helical outer contour corresponding to the screw-like or helical inner contour of the aperture 26 of the inner portion 23 of the stator 21. The rotor 30 may be made of a metallic material such as stainless steel, or from a suitable plastic material.

Between the rotor 30 and the drive shaft 28, a flex shaft 31 is provided connecting the rotor 30 to the drive shaft 28. Viewed in a longitudinal direction L of the rotor unit 27, which is oriented from the drive shaft 28 in the direction of the rotor 30 and parallel to the axis of symmetry 6, the flex shaft 31 is at least in part accommodated within the drive shaft 28. The flex shaft 31 may also be referred to as flexible shaft. Preferably, the flex shaft 31 is elastically deformable and enables an eccentric movement of the rotor 30 in the stator 21. The flex shaft 31 is used for torque transmission from the drive shaft 28 to the rotor 30.

The flex shaft 31 may be a steel cable which is, for example, coated or sheathed with a plastic material. The flex shaft 31 may also comprise one or more joints, in particular a universal or cardan joint, which also enable the eccentric movement of the rotor 30. In this case, the flex shaft 31 itself is not elastically deformable, and the eccentric movement of the rotor 30 is exclusively enabled by the joint or joints. The flex shaft 31 may also be a flexible rod, in particular, a plastic flexible rod, or may be referred to as such. In this case, the flex shaft 31 may be made, for example, from a Polyetheretherketone (PEEK), Polyethylene (PE) or the like. The flex shaft 31 may have a diameter of 3 mm or less, for example. The rotor 30 may have a diameter of 2 mm, 1.7 mm or 1.5 mm. The rotor 30 may also have a larger or smaller diameter.

The rotor 30 and the flex shaft 31 may be, for example, integrally formed, in particular are made of one material. In the present context, "integrally formed" or "one-piece" means that the flex shaft 31 and/or the rotor 30 form a common component and are not assembled from different components. In the present context, "from one material" means that the flex shaft 31 and the rotor 30 are made of the same material throughout. Furthermore, the drive shaft 28 may be integrally formed with the flex shaft 31 and/or the rotor 30, in particular, made of one material. In this case, the rotor unit 27 preferably is a plastic component. For example, the rotor unit 27 may be an integrally formed injection-molded plastic component.

Alternatively, the flex shaft 31, the rotor 30 and/or the drive shaft 28 may also be separate components that are, for example, inserted into one another and are thus either releasably or non-releasably connected to one another. For example, the flex shaft 31 may be made of a metallic material and the rotor 30 from a plastic material or vice versa. The flex shaft 31 may be sheathed with an elastomer. The rotor 30 may also be made of a metallic material. For example, the rotor 30 may be made of stainless steel. However, the rotor 30 may also be designed as a plastic component or ceramic component and may have various coatings.

When the rotor 30 is rotated in the stator 21, the medium M is conveyed, according to the endless piston principle, in the longitudinal direction L away from the drive shaft 28 by interacting with the aperture 26 of the stator 21. The feed volume per time unit depends on the speed, size, pitch and geometry of the rotor 30.

Such an eccentric screw pump 1 is, in particular, suitable for conveying a variety of media M, in particular, viscous, highly viscous and abrasive media M. The eccentric screw pump 1 belongs to the group of rotating positive displacement pumps. The main components of the eccentric screw pump 1 are the drive element 29, the rotatable rotor unit 27 and the fixed stator 21, in which the rotor 30 moves in a rotating manner. The rotor 30 is formed as a kind of knuckle thread screw with an extremely large pitch, large thread depth and small core diameter.

The at least partially elastically deformable stator 21 preferably has one more turn than the rotor 30 and twice the pitch length of the rotor 30. This way conveying chambers are created between the stator 21 and the rotor 30, which rotates therein and additionally moves radially, moving continuously from an inlet side of the stator 21 to an outlet side thereof. Valves for limiting the conveying chambers are not required. The size of the conveying chambers and thus the theoretical delivery rate depends on the pump size. A 360°-rotation of the rotor unit 27 with free discharge provides the volumetric delivery rate per revolution. The delivery rate of the eccentric screw pump 1 can thus be changed via the speed of the rotor unit 27. The actual delivery rate is dependent on an arising counter-pressure.

The medium M to be dosed always strives to achieve a pressure equalization from high to low pressure. Since the sealing between the rotor 30 and the stator 21 is not static, there will always be medium M flowing from the pressure side to the suction side. A characteristic curve shows these "slip losses" as the difference between the theoretical and the actual delivery rate.

The shape of the conveying chambers is constant, so that the medium M is not compressed. Thus, with the appropriate design, such an eccentric screw pump 1 can not only convey fluids but also solids. The shear forces acting on the medium M are very small, so that, for example, plant, animal and human cells can also be conveyed without causing damage. A particular advantage of such an eccentric screw pump 1 is that the eccentric screw pump 1 conveys continuously and with low pulsation. This makes them suitable for use in potting systems. Even high highly viscous and abrasive media can be conveyed without problem.

The eccentric screw pump 1 can thus be used to convey a wide variety of media M gently and with low pulsation. The spectrum of media M ranges from water to media M that no longer flow by themselves. Since the delivery rate is proportional to the speed of the rotor 30, the eccentric screw pump 1 combined with appropriate measurement and control technology can be used effectively for dispensing tasks.

The eccentric screw pump 1 combines in itself many positive characteristics of other pump systems. Like the centrifugal pump, the eccentric screw pump 1 has no suction and discharge valves. Like the piston pump, the eccentric screw pump 1 has an excellent self-priming capacity. Like the diaphragm or peristaltic pump, the eccentric screw pump 1 can pump any type of inhomogeneous and abrasive media M, which may also contain solids and fibers.

Media M in the form of multiphase mixtures are also conveyed safely and gently by the eccentric screw pump 1. Like the gear or twin screw pump, the eccentric screw pump 1 is capable of handling the highest viscosities of the medium M. Like the piston, diaphragm, gear or screw pump, the eccentric screw pump 1 has a speed-dependent, continuous delivery rate and is thus able to perform high-precision dispensing tasks.

The eccentric screw pump 1 can basically be used in all industrial sectors where special conveying tasks have to be solved. Examples include environmental technology, in particular conveying in the area of sewage treatment plants, the food industry, in particular for highly viscous media, such as syrup, quark, yogurt and ketchup, in the various low-germ processing stages, and the chemical industry, in particular for the safe conveying and dispensing of aggressive, highly viscous and abrasive media M.

The eccentric screw pump 1 can thus be used for the precise dispensing of a wide variety of media M. A repeatability of ±1% can be achieved. Various embodiments of the eccentric screw pump 1 also allow the application of two-component media M. Due to its design, namely that the rotor 30 moves in the medium M and an internal volume of the suction side must be filled, such an eccentric screw pump 1 always has a certain dead space. This dead space can be reduced by disposing the flex shaft 31 within the drive shaft 28, resulting in a reduction of the overall size in the longitudinal direction L. With this, in particular the size of the accommodating chamber 14 can be reduced.

As mentioned above, the rotor unit 27 comprises the flex shaft 31, which is elastically deformable. It enables the eccentric movement of the rotor 30 in the stator 21. During this eccentric movement of the rotor 30 in the stator 21, the flex shaft 31 performs a radial movement along a radial direction R of the rotor unit 27 within the drive shaft 28. The radial direction R is perpendicular to the longitudinal direction L and oriented away from it. As mentioned above, the eccentric movement of the rotor 30 can also be accomplished by means of a joint or multiple joints, in particular by means of universal joints or cardan joints. The stator 21 is subjected to a continuous load during operation, which is why it is subject to wear. This wear is compensated by regularly replacing the stator 21; the replacement intervals are dictated by the media M used as well as the process parameters.

Figure 2:
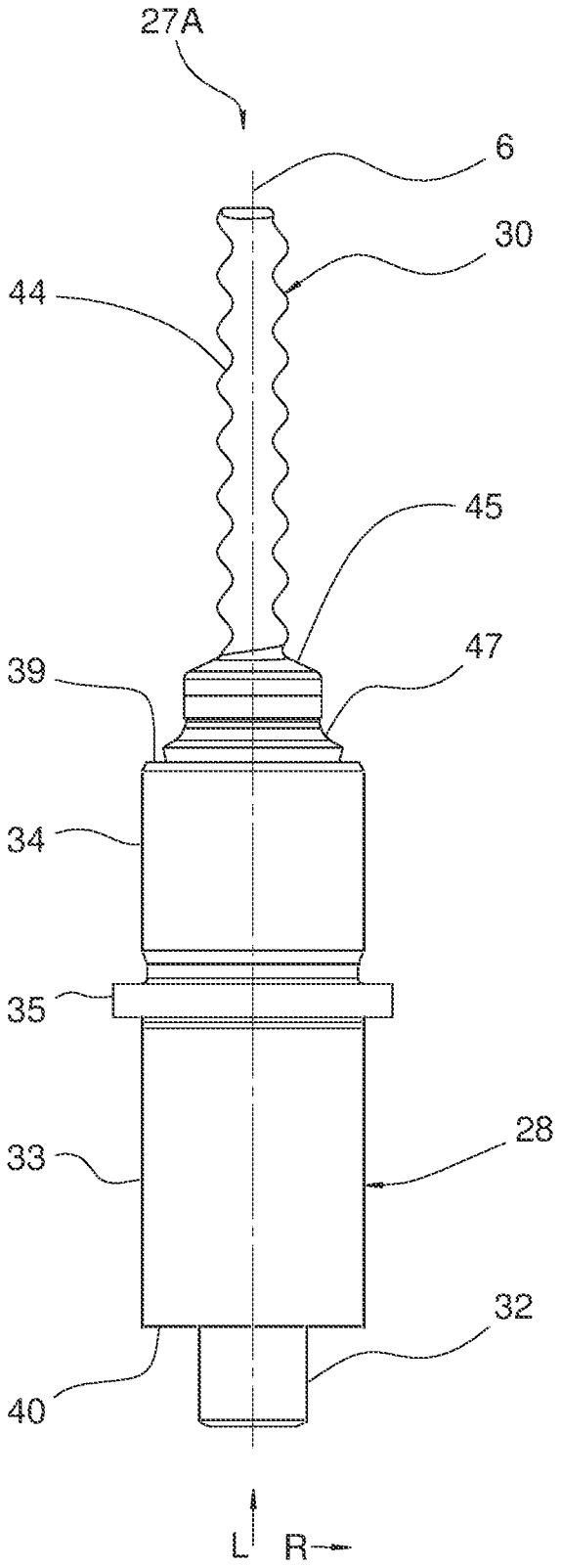
FIG. 2 shows a schematic view of an embodiment of a rotor unit for the eccentric screw pump of FIG. 1.
Figure 3:
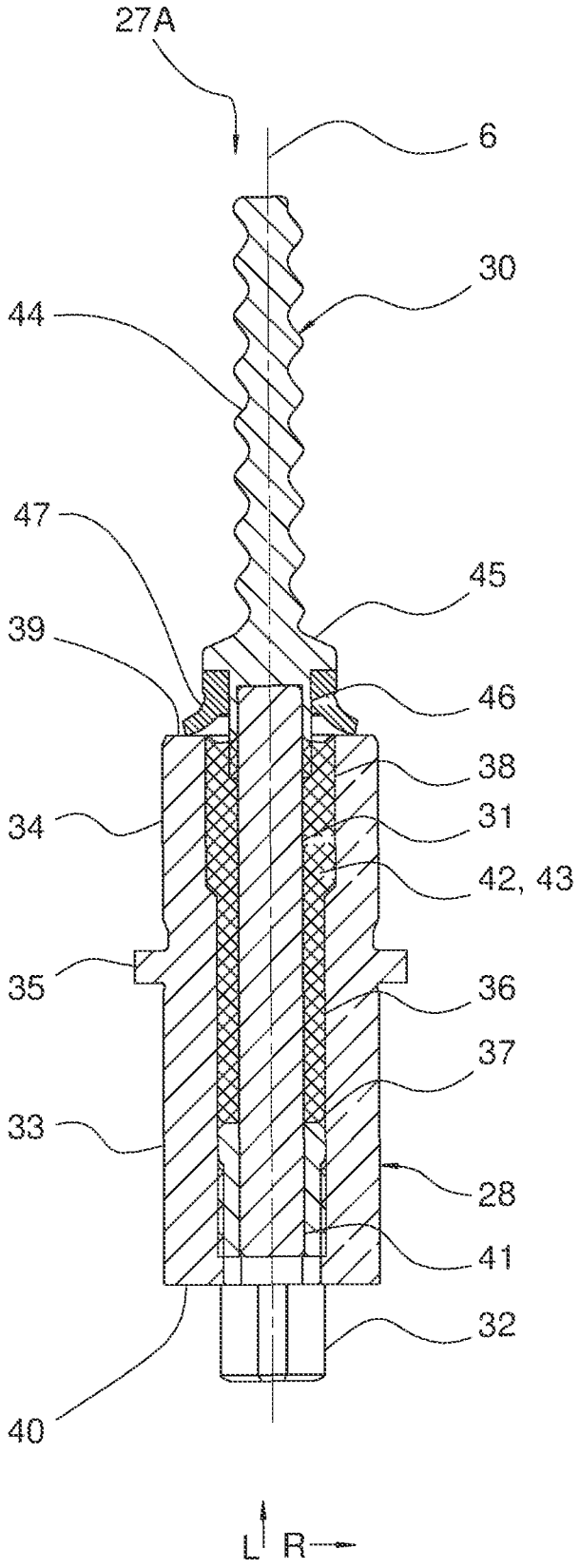
FIG. 3 shows a schematic cross-sectional view of the rotor unit of FIG. 2.

FIG. 2 shows a schematic view of another embodiment of a rotor unit 27A for the eccentric screw pump 1. FIG. 3 shows a schematic cross-sectional view of the rotor unit 27A. In the following, reference is made simultaneously to FIGS. 2 and 3.

As mentioned above, the rotor unit 27A comprises a drive shaft 28, a rotor 30 and a flex shaft 31 that connects the rotor 30 to the drive shaft 28. The drive shaft 28 comprises an interface 32 by means of which the rotor unit 27A can be coupled to the drive element 29. By means of the interface 32, the drive element 29 can transfer a torque onto the rotor unit 27A. The torque is transferred from the drive shaft 28 onto the flex shaft 31 and from the flex shaft 31 onto the rotor 30. For this purpose, the drive shaft 28, the flex shaft 31 and the rotor 30 are connected to one another in a rotationally fixed manner.

On its outside, the drive shaft 28 comprises a bearing face 33, on which the bearing elements 8, 9 can be mounted, and a sealing face 34. Preferably, the bearing face 33 and the sealing face 34 are designed cylindrically and rotationally symmetrical to the axis of symmetry 6. The sealing elements 17, 18 can sealingly abut the sealing face 34. Between the bearing face 33 and the sealing face 34, viewed in the longitudinal direction L, a circumferential shoulder 35 is provided, which, viewed in the radial direction R, extends beyond the bearing face 33 as well as the sealing face 34.

The drive shaft 28 further comprises a recess 36, in which the flex shaft 31 is accommodated. The recess 36 has a first end 37 facing away from the rotor 30 and a second end 38 facing the rotor 30. The recess 36 widens from the first end 37 toward the second end 38, so that the recess 36 has a smaller diameter at the first end 37 than at the second end 38. To this end, the recess 36 may be designed as a stepped bore, as shown in FIG. 3. However, the recess 36 may also have a conical or frustoconical geometry.

The drive shaft 28 further comprises a first end face 39 facing the rotor 30 and a second end face 40 facing away from the rotor 30. The drive shaft 28 has an interface 41 by means of which the flex shaft 31 is connected to the drive shaft 28 in a rotationally fixed manner. The interface 41 may, for example, comprise an adhesive joint, a screwed connection, a soldered joint, a welded joint, or the like. In this case, the flex shaft 31 is preferably designed to be a steel cable. However, the flex shaft 31 may also be made of a plastic material.

A gap 42, which fully extends around the flex shaft 31, is provided between the flex shaft 31 and the drive shaft 28. The gap 42 may be an air gap. Alternatively, the gap 42 may also be filled with a sealing compound 43, as shown in FIG. 3. The sealing compound 43 is elastically deformable, so that it does not hinder or only marginally hinders the radial movement of the flex shaft 31 in the gap 42. For this purpose, a material having a low Shore hardness may be used for the sealing compound 43.

For example, the sealing compound 43 may be or comprise a silicone, in particular a two-component silicone, a silicone that cures at room temperature or RTV silicone (Room Temperature Vulcanizing silicone), a silicone that cures at high temperatures, a Thermoplastic Elastomer (TPE), in particular a Thermoplastic Polyurethane (TPU), a Thermoplastic Vulcanizate (TPV), a Fluoro Vinyl Methyl Silicone Rubber (FVMQ) or the like. The sealing compound 43 may also be foamed on. The sealing compound 43 may have an open-cell or a closed-cell structure, for example. The sealing compound 43 may be sponge-rubber-like.

The rotor 30 is preferably made of steel, in particular stainless steel. However, the rotor 30 may also be made of a plastic material. The rotor 30 comprises an outer contour 44 as mentioned above, which is screw-like or helical. Facing the drive shaft 28, the rotor 30 comprises a circumferential shoulder 45. The rotor 30 further comprises an accommodating portion 46, which is sleeve-like and accommodates the flex shaft 31 at least in part within it. The flex shaft 31 is, for example, adhesively bonded, soldered or welded to the accommodating portion 46.

Between the shoulder 45 and the end face 39 of the drive shaft 28, an optional sealing element 47 is provided. The sealing element 47 may be made of rubber, for example. The sealing element 47 may also be made of a thermoplastic elastomer (TPE), in particular from a thermoplastic polyurethane (TPU). The sealing element 47 has a conical or frustoconical geometry.

Figure 4:
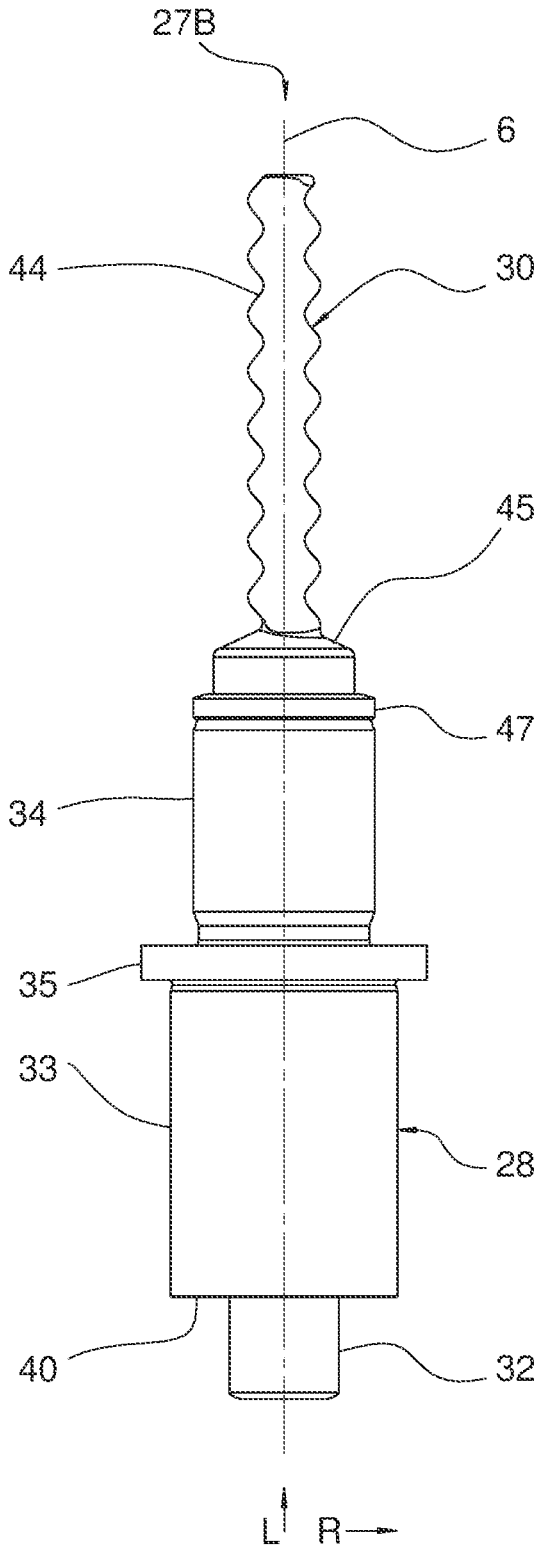
FIG. 4 shows a schematic view of another embodiment of a rotor unit for the eccentric screw pump of FIG. 1.
Figure 5:
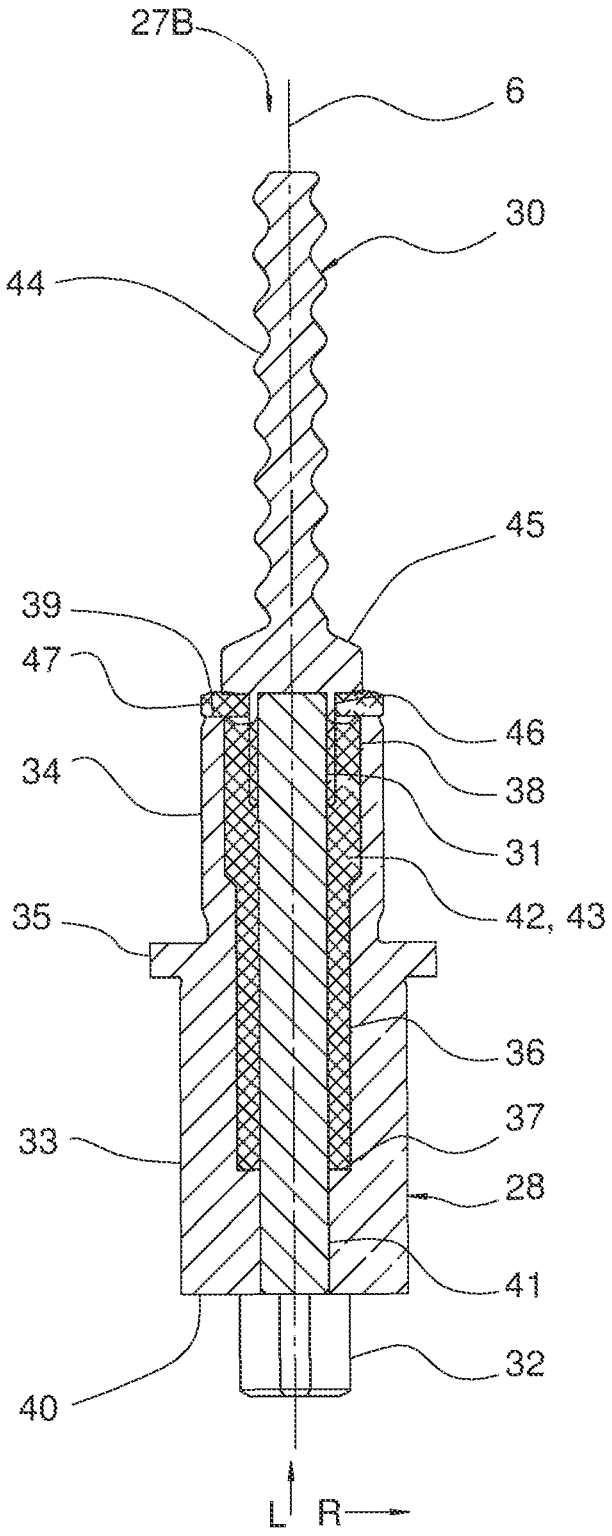
FIG. 5 shows a schematic cross-sectional view of the rotor unit of FIG. 4.

FIG. 4 shows a schematic view of another embodiment of a rotor unit 27B for the eccentric screw pump 1. FIG. 5 shows a schematic cross-sectional view of the rotor unit 27B. In the following, reference is made simultaneously to FIGS. 4 and 5.

Rotor unit 27B differs from rotor unit 27A only in that a disk-shaped sealing element 47 is provided instead of the conical or tapered sealing element 47 shown in FIGS. 2 and 3. In all other respects, the design of rotor unit 27B is the same as that of rotor unit 27A.

Figure 6:
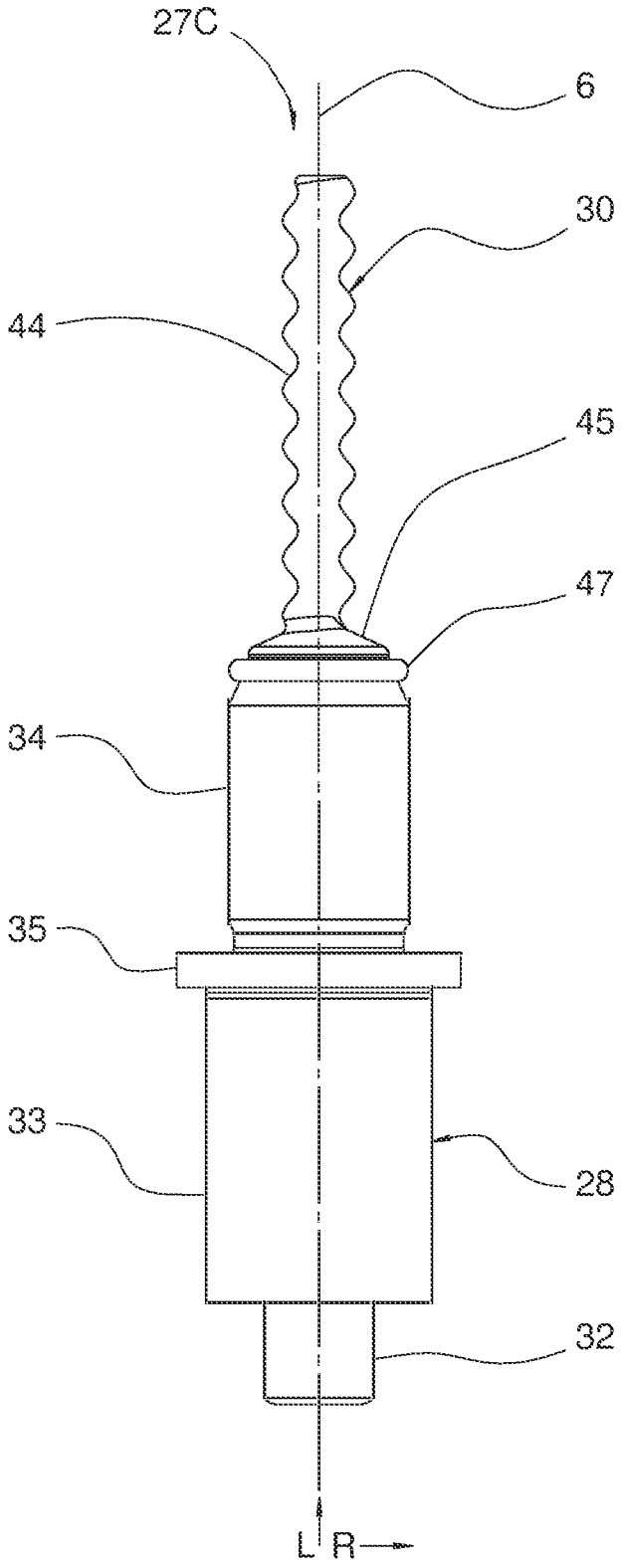
FIG. 6 shows a schematic view of another embodiment of a rotor unit for the eccentric screw pump of FIG. 1.
Figure 7:
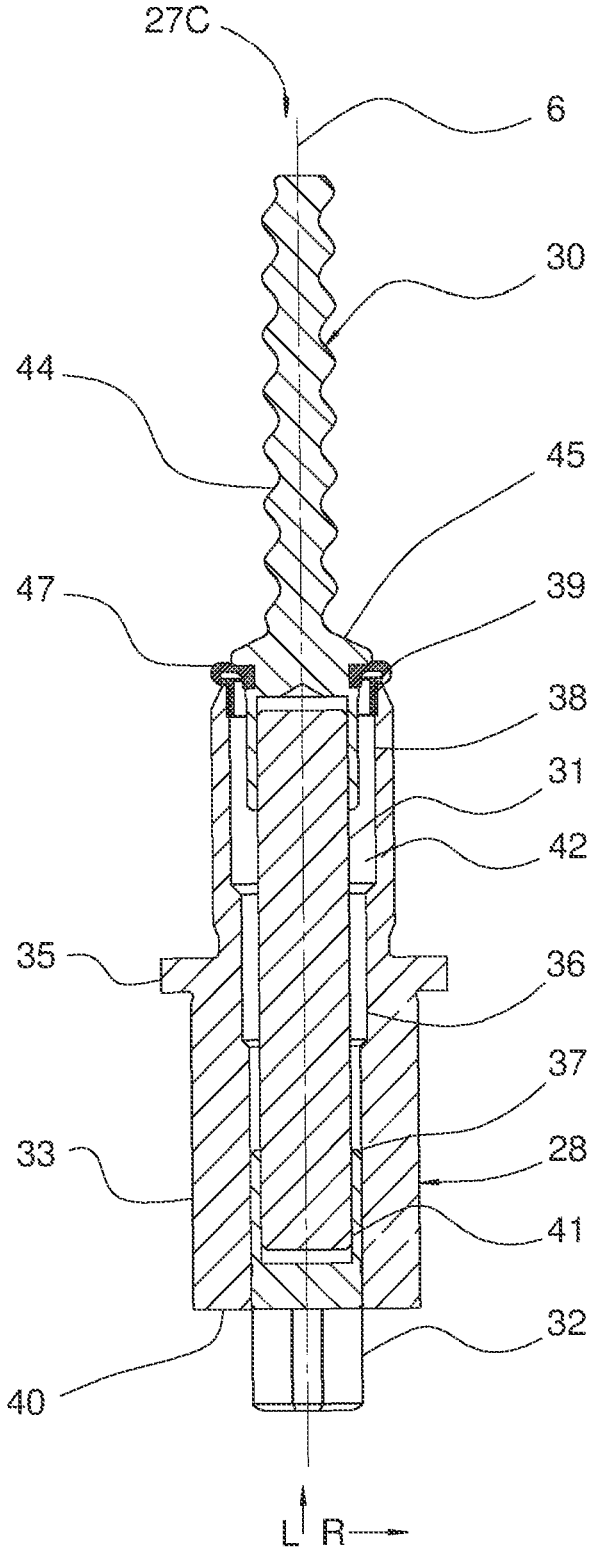
FIG. 7 shows a schematic cross-sectional view of the rotor unit of FIG. 6.

FIG. 6 shows a schematic view of another embodiment of a rotor unit 27C for the eccentric screw pump 1. FIG. 7 shows a schematic cross-sectional view of the rotor unit 27C. In the following, reference is made simultaneously to FIGS. 6 and 7.

Rotor unit 27C differs from rotor unit 27A only in that a bellows-like sealing element 47 is provided instead of the conical or tapered sealing element 47 shown in FIGS. 2 and 3. Furthermore, the rotor unit 27C does not comprise a sealing compound 43 accommodated in the gap 42. However, rotor unit 27C may optionally have the sealing compound 43.

Figure 8:
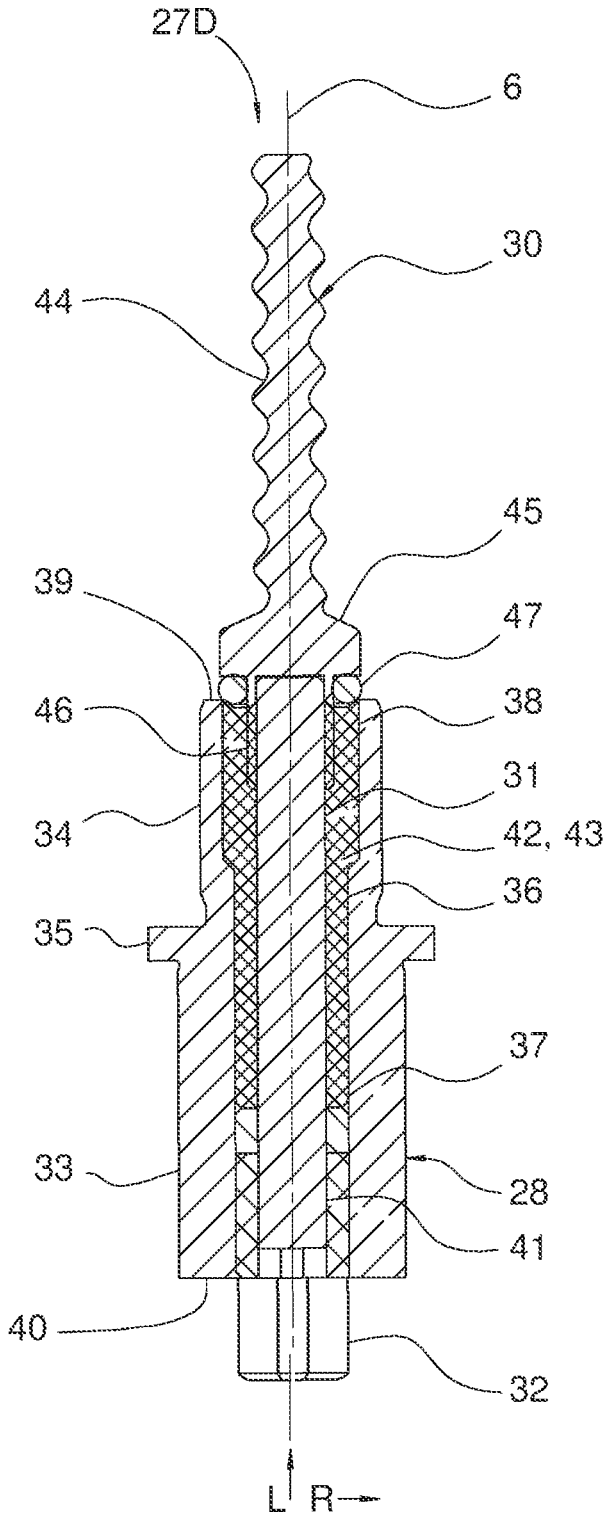
FIG. 8 shows a schematic cross-sectional view of another embodiment of a rotor unit for the eccentric screw pump of FIG. 1.

FIG. 8 shows a schematic cross-sectional view of another embodiment of a rotor unit 27D. Rotor unit 27D differs from rotor unit 27A only in that a sealing element 47 in the form of an O-ring is provided instead of the conical or tapered sealing element 47 shown in FIGS. 2 and 3. In all other respects, the design of rotor unit 27D is the same as that of rotor unit 27A.

Figure 9:
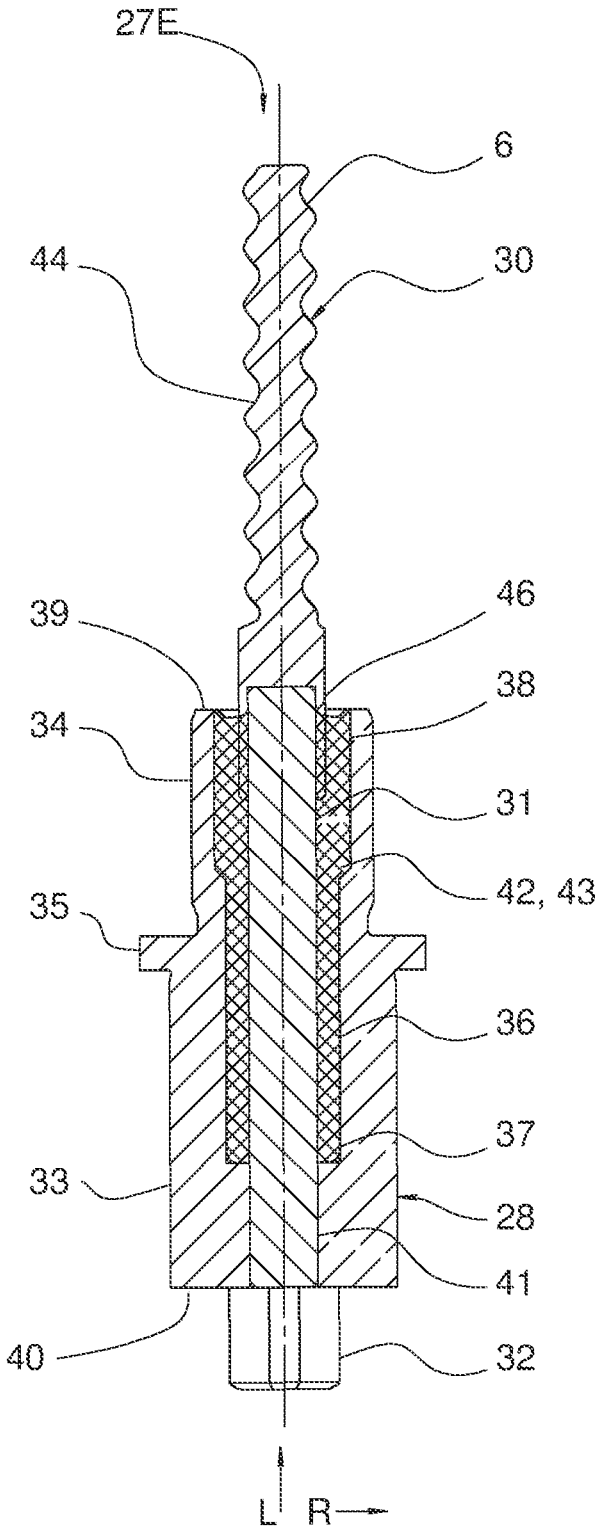
FIG. 9 shows a schematic cross-sectional view of another embodiment of a rotor unit for the eccentric screw pump of FIG. 1.

FIG. 9 shows a schematic cross-sectional view of another embodiment of a rotor unit 27E. Rotor unit 27E differs from rotor unit 27A only in that the rotor 30 does not have a circumferential shoulder 45 and that no additional sealing element 47 is provided. In all other respects, the design of rotor unit 27E is the same as that of rotor unit 27A.

Figure 10:
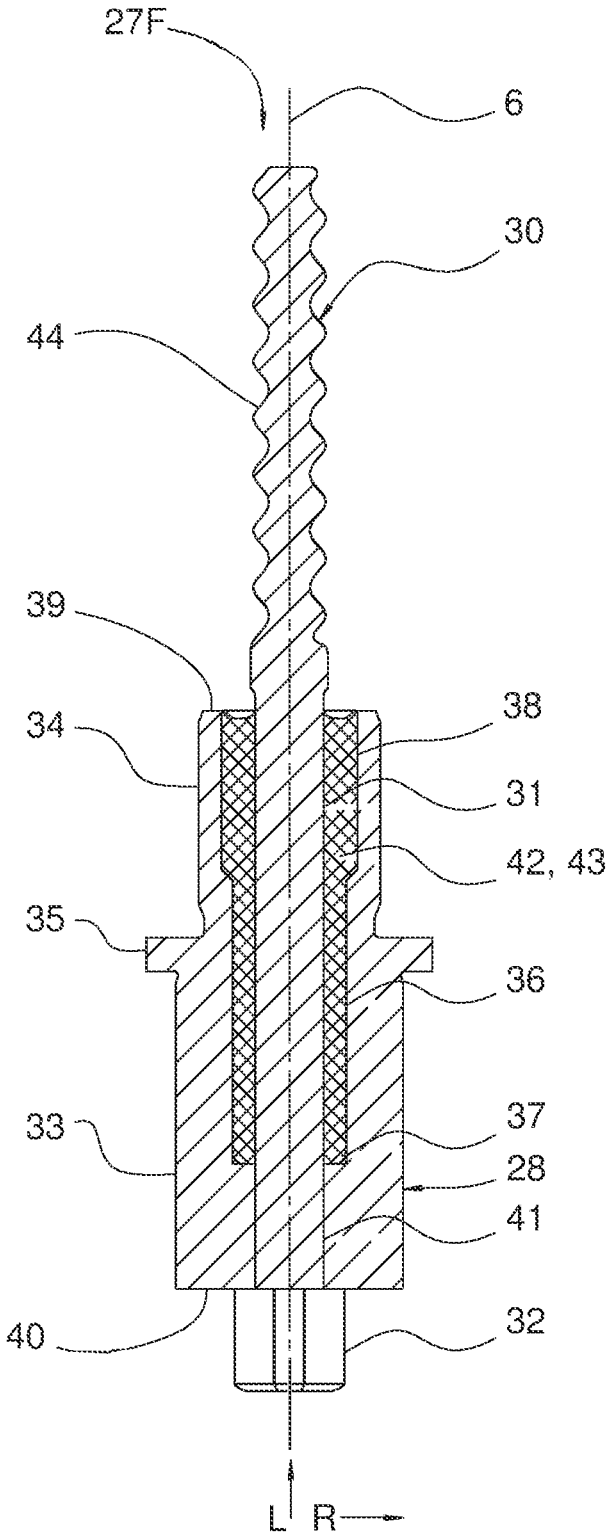
FIG. 10 shows a schematic cross-sectional view of another embodiment of a rotor unit for the eccentric screw pump of FIG. 1.

FIG. 10 shows a schematic cross-sectional view of another embodiment of a rotor unit 27F. Rotor unit 27F differs from rotor unit 27E only in that the rotor 30 and the flex shaft 31 are not two separately manufactured components that are fixedly connected to one another, but form a one-piece component, in particular, made of one material.

The rotor 30 and the flex shaft 31 are designed as an integrally formed injection-molded plastic component. In this case, the flex shaft 31 is a flexible rod, in particular a plastic flexible rod. Furthermore, the drive shaft 28 may also be made in one piece with the rotor 30 and the flex shaft 31, in particular, made of one material. I this case, the rotor unit 27E may be an integrally formed plastic component, in particular an injection-molded plastic component. The rotor unit 27F can be made in a multi-component plastic injection molding process so that the drive shaft 28, the flex shaft 31 and the rotor 30 can be manufactured as an integrally formed component using different plastic materials.

Figure 11:
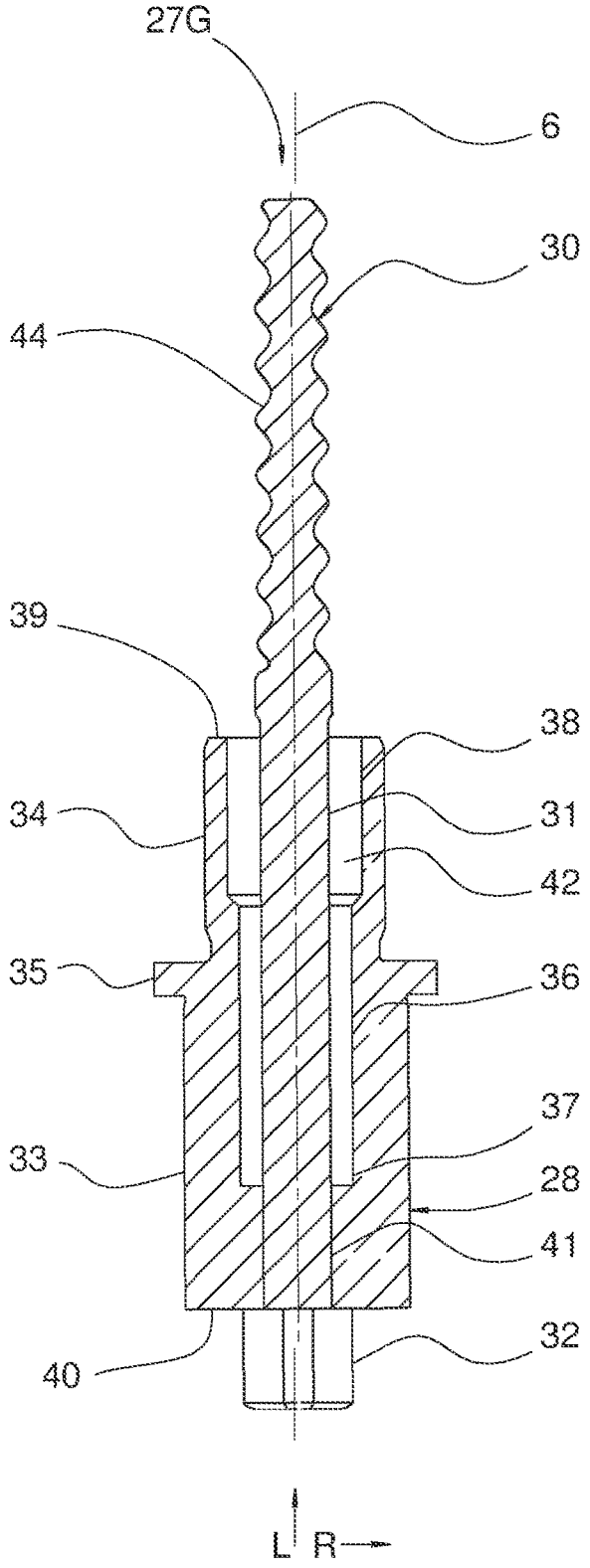
FIG. 11 shows a schematic cross-sectional view of another embodiment of a rotor unit for the eccentric screw pump of FIG. 1.

FIG. 11 shows a schematic cross-sectional view of another embodiment of a rotor unit 27G. Rotor unit 27G differs from rotor unit 27F only in that rotor unit 27G does not have a sealing compound 43. This means that the gap 42 extending around the flex shaft 31 is an air gap. Omitting the sealing compound 43 has the advantage that the additional work step of filling in the sealing compound 43 can be omitted. For example, the rotor unit 27G may then be produced as an injection-molded plastic component without further post-processing in the form of potting the gap 42 with the sealing compound 43.

Figure 12:
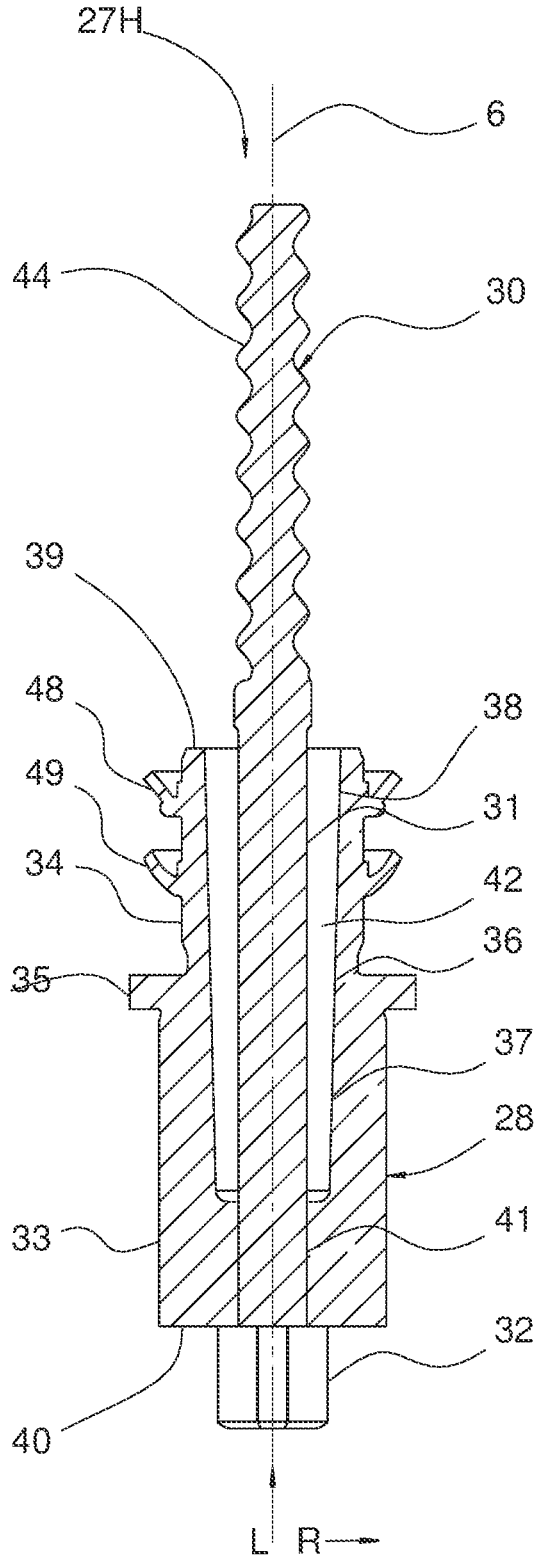
FIG. 12 shows a schematic cross-sectional view of another embodiment of a rotor unit for the eccentric screw pump of FIG. 1.

FIG. 12 shows a schematic cross-sectional view of another embodiment of a rotor unit 27H. Rotor unit 27H differs from rotor unit 27G only in that a first sealing lip 48 and a second sealing lip 49 are integrally formed on the drive shaft 28, in particular on the sealing face 34. The sealing lips 48, 49 are operable to form a radial seal with the sealing face 16 of the pump housing portion 4.

The sealing lips 48, 49 are injection-molded onto the drive shaft 28 in a plastic injection molding process. The sealing lips 48, 49 may be made of the same material as the drive shaft 28. Alternatively, the sealing lips 48, 49 may be made of a different material than the drive shaft 28. For this purpose, a multi-component plastic injection molding process may be used, for example.

The rotor unit (27, 27A, 27B, 27C, 27D, 27E, 27F, 27G, 27H) may be a disposable article. However, this is not mandatory. Alternatively, the rotor unit (27, 27A, 27B, 27C, 27D, 27E, 27F, 27G, 27H) may be used multiple times.

Disposable process solutions, also called single-use technologies, are in particular used for manufacturing biopharmaceutical products. This refers to complete solutions of disposable systems, which are also referred to as single-use systems, for an entire process line. This can include, for example, media and buffer production, bioreactors, cell harvesting, depth filtration, tangential flow filtration, chromatography and virus inactivation.

Various media M are required for biotechnical processes. These include nutrient solutions, cells, buffers for pH stabilization, and acids and bases for adjusting and regulating the pH value during cultivation. All media M used must be sterilized before use. In biotechnology, two main methods are used for this purpose, heat sterilization at at least 121° C. at 1 bar overpressure for at least 20 min and sterile filtration. For media M containing heat-sensitive components such as vitamins, proteins and peptides, sterile filtration is the method of choice.

The difference between disposable media and buffer production and conventional processes lies in the use of corresponding disposables, which are specially developed for this purpose, for example, special bags, disposable mixing systems and filters, and corresponding pumps. In contrast to conventional filters, the filters used are pre-sterilized. In some cases, bags, filters and pump heads are already connected together as a complete disposable system.

The entire system is supplied connected and pre-sterilized to avoid contamination. In addition to the aforementioned disposable processes, each of which is based on a basic procedural operation, special methods and equipment have been developed in the world of biopharmaceutical single-use production that are predominantly used only here, such as sterile couplings and tube welding equipment.

Available disposable process solutions are each to be considered as a self-contained module. Within the context of a single-use production process, the basic process engineering operations required for the production and purification of the target product are performed in sequence. The preconfigured disposable systems, which consist of tubing, disposable tanks, pump heads, and filtration or chromatography modules, are self-contained. Sterile connection technologies, usually hose connections, are therefore required to connect two successive process steps.

On the one hand, there are mechanical disposable couplings, on the other hand, there are devices with which thermoplastic hoses can be welded together in a sterile manner or existing connections can be cut and the hose ends welded together. For connection through a wall, special quick transfer systems have been developed. Currently, most production processes using disposables are still so-called hybrid processes, combining disposable systems with conventional stainless steel and glass systems. A distinction is made here between closed systems, in which the disposable systems are linked together in the sequence of the process steps, and station systems, in which the intermediate products are transported to the next process step by means of mobile containers.

In biopharmaceutical production, the term "single use" (often also referred to as "disposable") defines an item intended for single use. It is typically made of a plastic material such as Polyamide (PA) Polycarbonate (PC), Polyethylene (PE), Polyethersulfone (PESU), Polyoxymethylene (POM), Polypropylene (PP), Polytetrafluoroethylene (PTFE), Polyvinyl Chloride (PVC), Cellulose Acetate (CA) or Ethylene Vinyl Acetate (EVA), and is disposed of after use. The rotor unit (27, 27A, 27B, 27C, 27D, 27E, 27F, 27G, 27H) may be made of one or more of the materials named above. Single-use technology (SUT) means, in particular, a technology based on single-use systems (SUS).

In particular, the eccentric screw pump 1 can be used for additive or generative manufacturing. This means, that the eccentric screw pump 1 can be a 3D print head or can be referred to as such. 3D printing is a term encompassing all manufacturing methods where material is applied layer by layer, thus enabling the production of three-dimensional objects. The layer-by-layer construction is computer-controlled according to specified dimensions and shapes using one or more liquid or solid materials.

Physical or chemical hardening or melting processes take place in the course of the construction. Typical materials for 3D printing are plastics, synthetic resins, ceramics and metals. By now, carbon and graphite materials have also been developed to 3D print parts from carbon. Although it is a primary forming process, a specific product does not require special tools that have stored the particular geometry of the workpiece, such as molds. 3D printers are used in industry, pattern making and research to produce patterns, samples, prototypes, tools, final products or the like. Furthermore, they are also used for personal applications. In addition, there are applications in the home and entertainment sector, the construction industry, and in art and medicine.

These processes are used in the parallel production of very small components in large quantities, for unique pieces of jewelry or in medical and dental technology, both in small batch production and in the one-off production of parts with a high level of geometric complexity, even with additional functional integration. In contrast to primary forming, forming or subtractive manufacturing processes, such as cutting, the economic efficiency of 3D printing increases as the complexity of the component geometry increases and the required number of pieces decreases. In recent years, the areas of application for these manufacturing processes have been expanded to include other fields. 3D printers were initially used primarily for the production of prototypes and models, then for the production of tools, and finally for finished parts of which only small quantities are needed.

Some fundamental advantages over competing manufacturing processes are leading to increasing adoption of the technology, including in serial production of parts. Compared to injection molding, 3D printing has the advantage of eliminating the need for time-consuming mold making and mold changing. Compared to all material-removing processes, such as cutting, turning, drilling or the like, 3D printing has the advantage that additional processing steps after the initial forming are not required. In most cases, the process is more energy efficient, especially if the material is built up only once in the required size and mass. However, as with other automated processes, post-processing may be necessary depending on the application.

Further advantages are that different components can be produced on one machine and complicated geometries can be created. The use of the eccentric screw pump 1 for 3D printing is an extrusion-based process. The eccentric screw pump 1 makes it possible to process, for example, silicones, polyurethanes, ceramic and metal pastes, epoxy resins and acrylates as media M.

The advantages of the eccentric screw pump 1 over other technologies capable of printing liquids are its ability to handle high viscosities, its high precision and process stability, the wide range of materials that can be used, and the high application speed. Other technologies rely on sometimes extensive material adjustments to accomplish a useful printing process. Light-based technologies for liquids, for example, are always dependent on the presence of a photon crosslinker, whereas the eccentric screw pump 1 can print completely independently of the curing mechanism.

In particular, the eccentric screw pump 1 can be used for so-called bioprinting. The application area of bioprinting is still very young and represents the latest step in cell culture technology. It is to be understood as a special form of additive manufacturing at the interface between medical technology and biotechnology. The topic of bioprinting often comes up with regards to the great need for donor organs. It is said to be vital that, in the future tissue, and organs are artificially produced to meet the enormous demand. Realistically speaking, this vision is still a long way off, should it ever become reality.

Nevertheless, the use of simpler tissue constructs is moving ever closer. For example, cartilage implants or replicated skin sections for rapid wound care are conceivable. Furthermore, bone waxes and bone substitute materials can also be processed. Customized bone implants made of body-compatible materials are already in use. However, this cannot be regarded as bioprinting in the narrower sense, since no biological materials are used.

Great potential can be seen in the research field of "drug discovery". Here, knowledge about side effects and interactions of different active ingredients can be gained within a very short time. To this end, "mini organs" are printed that can reproduce all the essential functions of a real organ. Using microfluidic techniques, these mini organs can be combined to form multi-organ systems, allowing the systemic effects of active ingredients to be tested without the need for animal experiments.

In bioprinting, the eccentric screw pump 1, in particular a bioprinter, is used to generate cell-loaded gels or matrixes for the preservation and cultivation of the same. This is done by means of a layered construction, which is known from additive manufacturing. Since most media M in bioprinting are loaded with living cells, which can only be produced at considerable time and cost, gentle dispensing is essential. The stress on the dispensed cells increases with the cell density and viscosity of the media M. However, the highest possible cell density and stability are required for useful constructions. Thus, there is an interplay between cell concentration and dispensing technology.

In order to use the eccentric screw pump 1 in existing 3D printers, a reduction in weight and size is desirable. The materials for the eccentric screw pump 1 are selected to be as light as possible. The housing 2 may be partially made of metal or plastic. The fact that the components of the rotor unit 27, 27A, 27B, 27C, 27D, 27E, 27F, 27G, 27H and the stator 21 can be made of a plastic material, additionally reduces the weight. Due to the reduced overall size of the rotor unit 27, 27A, 27B, 27C, 27D, 27E, 27F, 27G, 27H in the longitudinal direction L, a weight reduction can also be achieved.

In addition to the use of the eccentric screw pump 1 in the field of bioprinting, other areas of application are also conceivable. In additive manufacturing, the use of the eccentric screw pump 1 does not have to be limited to bioprinting. Printing materials such as silicones, epoxy resins, polyurethanes, ceramic, metal and solder pastes is also possible. With a compact design, it is also conceivable to open up the market for amateur 3D printers.

Furthermore, use in the chemical industry is also possible. Some chemicals are fundamentally unsuitable for printing with eccentric screw pumps 1 due to their tendency to conglutinate. For example, cyanoacrylates pose a problem because they may cure in the presence of moisture and can completely destroy the eccentric screw pump 1. A rotor unit 27, 27A, 27B, 27C, 27D, 27E, 27F, 27G, 27H designed as a disposable that, in the event of a failure, can be quickly exchanged without a great loss is thus advantageous.

In medical technology, one conceivable application of the eccentric screw pump 1 would be as a hand-held applicator. The eccentric screw pump 1 can be used for precise application of the medium M in wound care, in the body, during operations, in dental treatments or for dispensing drugs. One interface of additive manufacturing and medical technology is, for example, the printing of tablets. By individually creating tablets with patient-specific active ingredients and active ingredient contents, problems with interactions, overdosing and underdosing, and forgetting to take the medication can be counteracted. The eccentric screw pump 1 can also be used for printing tablets.

The eccentric screw pump 1 can also be used for microdosing in the field of production of film-coated tablets, for dosing vaccines, active ingredients, in particular expensive active ingredients, or for patch application by dosing. The eccentric screw pump 1 can also be used for microdosing in aseptic application. The eccentric screw pump 1 can also be used for the production of very small components, for example for adhesively bonding endoscopes. Furthermore, the eccentric screw pump 1 can be used for dispensing expensive active ingredients, either in a continuous or discontinuous process. It is also possible to produce personalized tablets, in particular film-coated tablets. It is also possible to use several active ingredients in one tablet, especially a film-coated tablet, or on active patches. The eccentric screw pump 1 can also be used in cosmetics, in particular in personalized cosmetics, for dosing very small quantities.

The eccentric screw pump 1 may be mains powered or battery powered. This means that the eccentric screw pump 1 can be operated with batteries. This way the eccentric screw pump is 1 independent from a power grid. Thus the eccentric screw pump 1 can function as a self-contained hand-held device. The eccentric screw pump 1 can thus be used for dispensing solder paste at a manual work station, for example. The eccentric screw pump 1 can thus be used in the manner of a pipetting device or pipetting aid, with the difference that by using the eccentric screw pump 1 even highly viscous media can be dispensed.

Furthermore, an eccentric screw pump 1 functioning in such a self-contained manner can also be used for rapid wound care, for example for field care of military personnel, in doctor's offices or in the operating room. In this case, for example, waxes, in particular bone waxes, adhesives, medications, dental prostheses materials, artificial skin or the like can be dispensed.

Although the present invention has been described using examples, it can be modified in many ways.

LIST OF REFERENCE NUMBERS

1 Eccentric screw pump
2 Housing
3 Front housing portion
4 Pump housing portion

5 Bearing housing portion
6 Axis of symmetry
7 Bore
8 Bearing element
9 Bearing element
10 Shoulder
11 Groove
12 Locking ring
13 Sealing element
14 Receiving chamber
15 Infeed opening
16 Sealing face
17 Sealing element
18 Sealing element
19 Projection
20 Bore
21 Stator
22 Outer portion
23 Inner portion
24 Base section
25 Luer-lock connector
26 Aperture
27 Rotor unit
27A Rotor unit
27B Rotor unit
27C Rotor unit
27D Rotor unit
27E Rotor unit
27F Rotor unit
27G Rotor unit
27H Rotor unit
28 Drive shaft
29 Drive element
30 Rotor
31 Flex shaft
32 Interface
33 Bearing face
34 Sealing face
35 Shoulder
36 Recess
37 End
38 End
39 End face
40 End face
41 Interface
42 Gap
43 Sealing compound
44 Outer contour
45 Shoulder
46 Receiving portion
47 Sealing element
48 Sealing lip
49 Sealing lip
L Longitudinal direction
M Medium
R Radial direction

The invention claimed is:

1. A rotor unit for an eccentric screw pump, comprising
a drive shaft which is drivable by means of a drive element of the eccentric screw pump,
a helical rotor, and
a flex shaft connecting the drive shaft to the rotor,
wherein the flex shaft is at least in part accommodated within in the drive shaft,
wherein, between the flex shaft and the drive shaft, a gap extending around the flex shaft is provided, which allows for a radial movement of the flex shaft within the drive shaft, and
wherein the drive shaft, the rotor and the flex shaft form an integral component, so that the drive shaft, the rotor and the flex shaft form a common component and are not assembled from different components.

2. The rotor unit according to claim 1, wherein the drive shaft comprises a cylindrical bearing face on its outside, and wherein the flex shaft extends at least in part within the bearing face.

3. The rotor unit according to claim 1, wherein the drive shaft comprises a recess, in which the flex shaft is accommodated, and wherein the recess widens from a first end of the recess facing away from the rotor to a second end of the recess facing the rotor.

4. The rotor unit according to claim 3, wherein the recess is stepped or conical.

5. The rotor unit according to claim 3, wherein, on the first end, the flex shaft is fixedly connected to the drive shaft.

6. The rotor unit according to claim 1, wherein the gap is at least in part filled with an elastically deformable sealing compound.

7. The rotor unit according to claim 6, wherein the sealing compound is foamed.

8. The rotor unit according to claim 1, further comprising a sealing element, which is disposed on an end face between the drive shaft and the rotor.

9. The rotor unit according to claim 8, wherein the rotor comprises a circumferential shoulder, and wherein the sealing element is disposed between the shoulder and an end face of the drive shaft.

10. The rotor unit according to claim 8, wherein the sealing element is bellows-shaped.

11. The rotor unit according to claim 1, wherein the flex shaft is completely accommodated within the drive shaft, as viewed in a longitudinal direction of the rotor unit.

12. The rotor unit according to claim 1, wherein the drive shaft comprises on its outside at least one sealing lip, which is integrally formed with the drive shaft, for sealing the drive shaft against a housing of the eccentric screw pump.

13. The rotor unit according to claim 1, wherein the drive shaft, the rotor and the flex shaft form a component made of one material.

14. The rotor unit according to claim 1, wherein the rotor unit is a disposable article.

15. An eccentric screw pump comprising a rotor unit according to claim 1.

16. The eccentric screw pump according to claim 15, wherein the eccentric screw pump is a 3D print head.

* * * * *